US007134894B2

(12) United States Patent
Murphy et al.

(10) Patent No.: US 7,134,894 B2
(45) Date of Patent: Nov. 14, 2006

(54) COAXIAL ELECTRICAL CONNECTOR FOR HAZARDOUS LOCATIONS

(75) Inventors: Joseph F. Murphy, Highland Park, IL (US); Brandon Janowiak, Palatine, IL (US)

(73) Assignee: Woodhead Industries, Inc., Deerfield, IL (US)

( * ) Notice: Subject to any disclaimer, the term of this patent is extended or adjusted under 35 U.S.C. 154(b) by 0 days.

(21) Appl. No.: 11/390,322

(22) Filed: Mar. 27, 2006

(65) Prior Publication Data

US 2006/0172579 A1 Aug. 3, 2006

Related U.S. Application Data

(62) Division of application No. 11/128,751, filed on May 13, 2005, now Pat. No. 7,033,195.

(60) Provisional application No. 60/571,704, filed on May 17, 2004, provisional application No. 60/571,107, filed on May 14, 2004.

(51) Int. Cl.
*H01R 13/62* (2006.01)

(52) U.S. Cl. ..... 439/307

(58) Field of Classification Search ..... 439/307, 439/308, 306, 133
See application file for complete search history.

(56) References Cited

U.S. PATENT DOCUMENTS 1,998,129 A * 4/1935 Fullman ..... 439/133
3,861,770 A * 1/1975 Horak ..... 439/133
3,953,097 A * 4/1976 Graham ..... 439/307

* cited by examiner

*Primary Examiner*—Phuong Dinh
(74) *Attorney, Agent, or Firm*—Emrich & Dithmar LLC

(57) ABSTRACT

Disclosed are two embodiments of a coaxial electrical connector designed for use in hazardous locations. Mating connectors are connected coaxially, and coupled together by means of a threaded connection. When the mating connectors are connected, they cannot be disconnected manually. Rather, a tool is necessary to disconnect the connectors. In one embodiment, each connector includes a generally cylindrical coupler member having integral, axial fingers or tines spaced circumferentially. The couplers are rotatably mounted to inserts in which the connecting elements are embedded. A ratchet assembly permits the couplers to be threaded together to make a connection but is overridden in the unconnecting direction, requiring a tool to be placed in the space between adjacent tines to connect the coupler to an associated outer housing which may then be turned to disconnect the connectors. In a second embodiment, coupling members are provided with a ratchet interface surface having interlocking, yieldable teeth so that when the coupling members are secured by hand, a retaining force secures the coupling members together and prevents disconnection by manual force alone, requiring tools to deform the teeth and disconnect the connectors.

7 Claims, 7 Drawing Sheets

COAXIAL ELECTRICAL CONNECTOR FOR HAZARDOUS LOCATIONS

RELATED APPLICATIONS

This application is a divisional of U.S. application Ser. No. 11/128,751 filed May 13, 2005 now U.S. Pat. No. 7,033,195 and claims the benefit of co-pending, co-owned provisional application 60/571,107 for "Electrical Connector for Hazardous Locations" filed May 14, 2004 and co-pending and co-owned provisional application 60/571,704 for "Electrical Connector for Hazardous Locations" filed May 17, 2004.

FIELD OF THE INVENTION

This invention relates generally to electrical connectors; and more particularly, it relates to coaxial electrical connectors which are designed to be connected manually (i.e. without tools), but which require tools such as a pliers or special wrench or device, to disconnect the mating male and female connectors. One application for connectors of this type is for use in so-called hazardous locations, such as petroleum processing and chemical manufacturing plants, where it is desired to avoid electrical arcing.

BACKGROUND OF THE INVENTION

Electrical connectors of the type referred to as "quick disconnect" connectors are in widespread use in many industrial applications, such as manufacturing automation. The term "quick disconnect" connectors generally refers to connectors which may be assembled together in coaxial relation, and then coupled together mechanically, for example, by a threaded coupling nut (or simply, "coupling"). These connectors have gained increasingly wider acceptance in industries requiring modifications to manufacturing facilities. That is, "quick disconnect" refers to electrical connections which are modular and wherein the connectors may be disconnected and re-connected, perhaps in a different configuration, as opposed to hard wiring of electrical connections.

Currently available commercial quick disconnect connectors are not readily usable in applications involving so-called hazardous locations. In hazardous locations, it is specifically desired that "quick disconnect" electrical connections be incapable of manual disconnect because a spark may result, creating a hazard. Thus, in hazardous locations it is desirable that the connectors be disconnected only with a tool, to avoid inadvertent or unintentional disconnects. The present invention relates to such connectors.

SUMMARY

A first embodiment of a coaxial, quick disconnect electrical connector which may be connected manually but may only be disconnected with tools includes a tubular insert housing which may be made of metal and which receives and secures a non-conducting insert in which the connecting elements of the connector are embedded.

A ratchet assembly comprising an outer housing and a coupler is rotatably mounted to the exterior of the insert housing and restrained against axial movement relative to the insert. In this sense, "axial" refers to a longitudinal center line of the connectors extending in the direction of connection/disconnect.

The coupler is threaded for fastening to a mating connector, and has an annular shoulder for limiting the forward axial motion of the outer housing, and a plurality of rearwardly extending, resilient flexible tines or fingers received in a cylindrical rear portion of the outer housing. An annular rear wall of the outer housing is rotatably coupled to the insert housing to restrain the coupler and the outer housing (comprising the ratchet assembly) against axial motion relative to the insert housing.

The outer housing includes teeth which lock the coupler and outer housing together against relative rotational motion when the outer housing is rotated in a thread-engaging direction. The teeth permit the outer housing to override the fingers in the reverse (i.e. thread-disengaging) direction to prevent manual disconnection. A tool placed in an aperture in the side wall of the outer housing and extended between adjacent fingers of the coupler, fixes the outer housing to the coupler so that turning the outer housing with the tool in place will allow the coupler to rotate in the reverse (thread-disengaging) direction, thereby disconnecting the connector from a mating electrical connector. However, with the tool removed from the aperture of the side wall if one were to attempt to disconnect the connector by manually rotating the outer housing in a counter direction (i.e. thread-disengaging), the outer housing simply rides over the coupler due to the override arrangement of the ratchet assembly.

A corresponding mating male connector includes male electrical connecting elements embedded in the insert and exterior threads on the coupler. The mating connectors are otherwise complementary. The mating female connector may have inner threads on the coupler and female electrical connecting elements are embedded in the insert.

If the insert housings and couplers are made of metal, RFI protection can extend from cable to cable and across both connectors when assembled (i.e. connected) together and used to connect cables or cords.

A male connector of a second embodiment of the invention includes a male connector insert carrying connecting elements or contacts and provided with an interface overmold protecting the junction between cord and the insert. A coupler in the general form of a sleeve having external threads adjacent the connecting end of the coupler is rotatably mounted on the insert.

A coupler overmold is fixed to the rear and outer surface of the male coupler and extends forwardly about the periphery of the male coupler but does not cover the threads, thus forming an integral body with the male coupler. A forward, radial face of the coupler overmold defines a first ratchet interface surface with adjacent ramps and axial engaging or locking surfaces.

A mating female connector of the second embodiment includes a female connector insert carrying female connecting elements for mating with the male connecting elements, and a connector overmold covering the cord/insert interface. A second (or "female") coupler having internal threads for engaging the male threads of the male coupler is rotatably mounted on the female connector insert. A second coupler overmold is fixed to the rear of the female coupler and extends about the outer periphery of the female coupler to form a second ratchet interface surface for progressive engagement and locking coupling with the first ratchet interface surface of the coupler overmold of the mating connector when the two connectors are connected.

The overmolds of the male and female couplers are made of plastic or other suitable yieldable material which permits progressive inter-engagement of the two ratchet interface surfaces as the connectors are assembled and tightened to provide a coupling force between the connectors which makes it very difficult or impossible to uncouple the couplers and disconnect the connectors manually. The coupling/uncoupling forces may be varied according to the hardness of the material chosen for the coupler overmolds or the angles of the adjacent ramps and axial latching surfaces of the ratchet interface surfaces to cover a range of coupling forces from merely resistant to manually difficult to those requiring a tool to de-couple.

When sufficient force is applied, whether manually or with pliers or other torquing hand tools, depending on the application and design, the materials of the coupler overmolds permit the axial locking surfaces of the engaged ratchet interface surfaces to deform, thus allowing the ratchet interface surfaces to ride over one another without permanent deformation to disconnect the connectors. Additionally, the opposing ratchet surfaces of the coupled male/female elements eliminate or reduce the possibility of accidental separation due to environmental vibration.

Other features and advantages of the present invention will be apparent from the following detailed description accompanied by the attached drawing wherein identical reference numerals will be used to refer to like parts in the various views.

DETAILED DESCRIPTION OF THE ILLUSTRATED EMBODIMENTS

Figure 1:
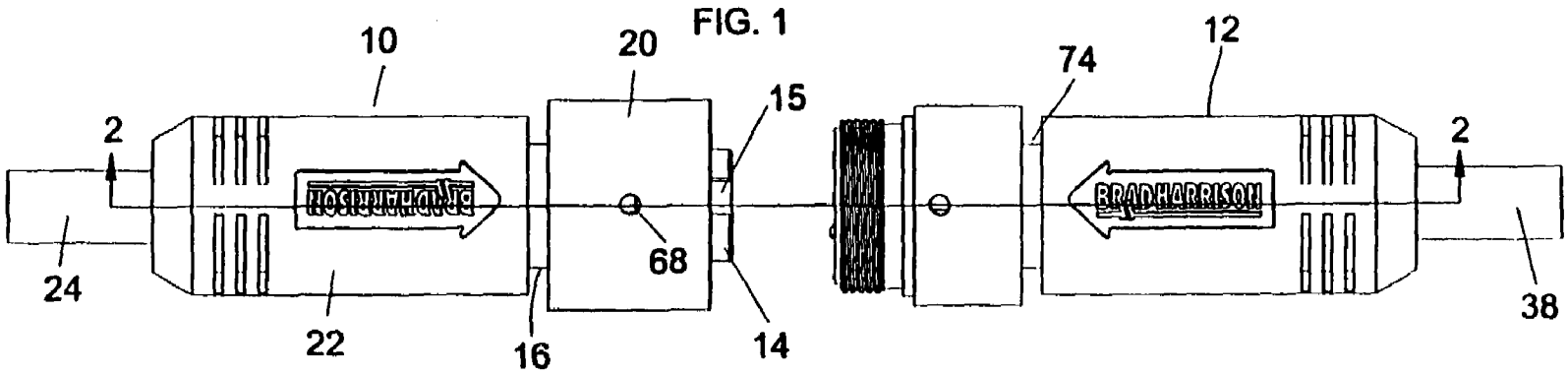
FIG. 1 is a side view of male and female connectors of a first embodiment in a position just prior to assembly or connection.

Referring first to FIG. 1, reference numeral 10 generally designates a female electrical connector adapted to be connected to a male quick-connect electrical connector generally designated 12. Before turning to the details of the components, reference is made to FIGS. 3 and 4 to identify the major components of the connectors 10, 12. Turning first to the female connector 10, it includes a female insert 14 of non-conducting material which is secured within an insert housing 16. As seen in FIG. 4, individual connecting elements 15A are embedded in the individual sockets 41 of insert 14. Surrounding the insert housing 16 is a ratchet assembly generally designated 18 and comprising a female coupler 19 and an outer housing generally designated 20. The distal end of the insert housing 16 extends to the rear (i.e. leftward in FIGS. 1 and 3) and is embedded in a connector overmold 22 which also encompasses the adjacent end of the cord or cable 24 to which the connector 10 is attached. The protective overmold 22 is intended to protect the interface between the conductors of the cable or cord 24 and the electrical connecting elements 15A secured within the female insert body 14, as is known in the art, and will be described further below.

As used herein, "forward" and "rear" refer to locations on either the male or female connector in relation to the direction of connection. That is, the forward portion is the portion close to the mating connector, and "rear" refers to the part of the connector which is remote or distal from the interface with the mating connector.

Figure 3:
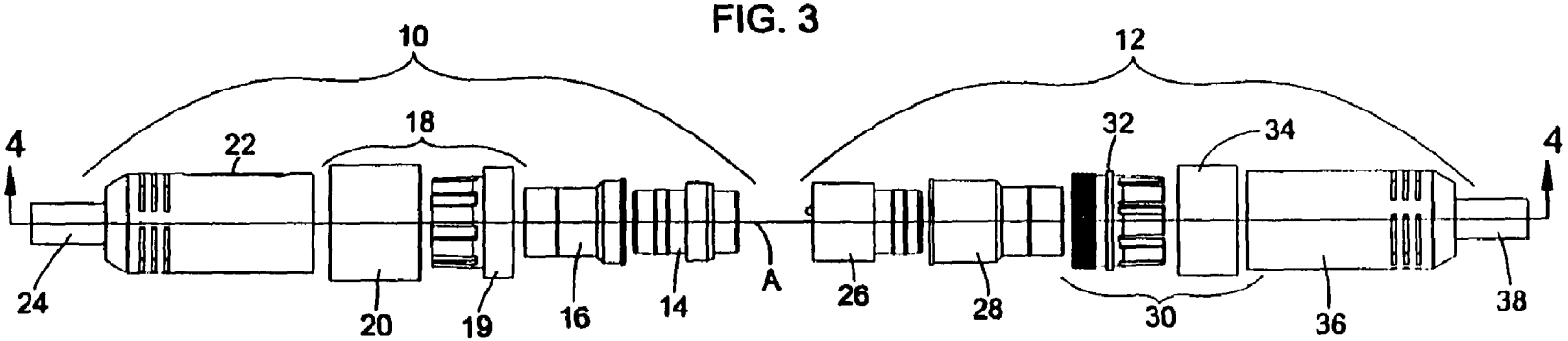
FIG. 3 is a view similar to FIG. 1, but with the various components in axially aligned, exploded relation.
Figure 4:
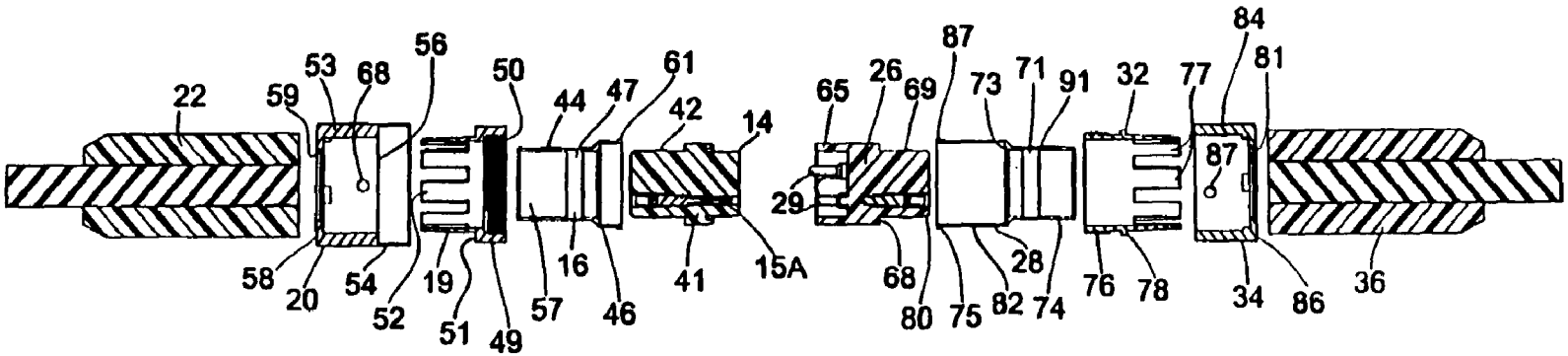
FIG. 4 is a cross sectional view taken through the sight line 4—4 of FIG. 3.

Still referring to FIGS. 3 and 4, the male connector 12 includes similar component parts including a non-conducting male insert 26 in which male connecting elements 29 are embedded, an insert housing 28, a male ratchet assembly 30 comprising a male coupler 32 having exterior threads 76, and a male outer housing 34, and a connector overmold 36 for overmolding the interface between the insert 26 and a second cable 38 (FIG. 3).

As persons skilled in the art will appreciate, the female insert 14 has embedded in it a plurality of female connecting elements (see 15A in FIG. 4) which may be in the form of sleeves or sockets; and each female connecting element is directly connected to and receives an associated conductor of the cable 24. As is conventional, there may be one to five or more connecting elements in each of the inserts, and the female insert may include a keyway such as that designated 15 in FIG. 1 to receive an associated key such as that designated 27 in FIG. 2 of the male insert 26 to insure proper pin-to-pin connections.

Referring back to FIG. 2, the male insert 26 houses male connecting elements such as those designated 29 in FIGS. 2 and 4 in the form of prongs or pins embedded in the body of the insulating male insert 26. The male connecting elements are connected to the conductors of cable 38 and adapted to make an electrical connection with associated ones of the female connecting elements 15A of the mating connector 10.

The components of the female connector 10 will now be described in more detail, and with references to FIGS. 4 and 5–9.

Figure 7A:
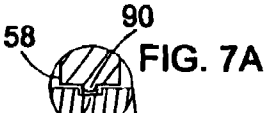
FIG. 7A is an enlarged cross sectional view of the rotational coupling between the outer housing and the insert housing as defined by circle 7A—7A of FIG. 7.
Figure 7:
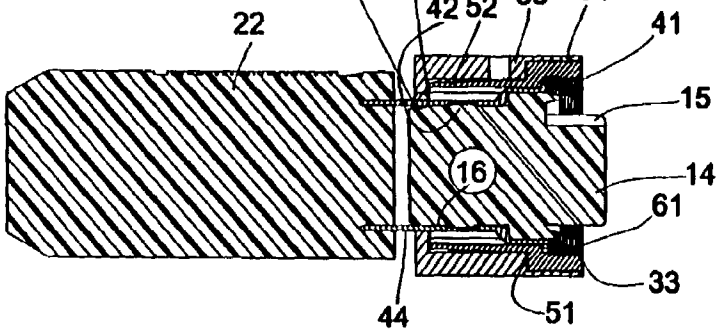
FIG. 7 is a cross sectional view of the connector of FIG. 5 taken through the sight line 7—7.
Figure 10:
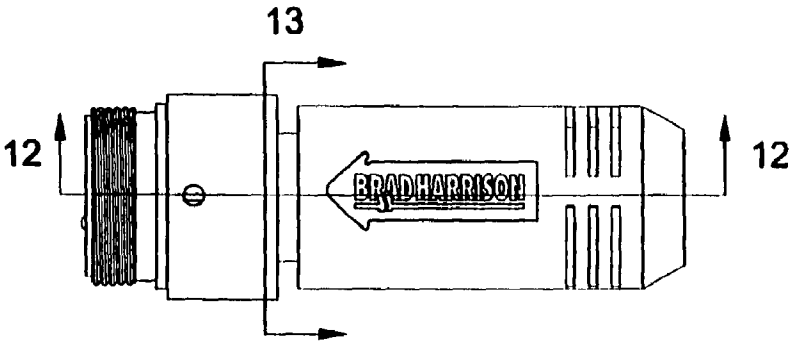
FIG. 10 is a side view of the male connector of FIG. 1.

Turning now to the female insert 14, as best seen in FIGS. 4 and 7, it includes a peripheral raised band or rib 41 spaced radially outwardly of a generally cylindrical insert body 14. Behind the band 41 is a second annular rib 42 which may be, as illustrated, raised above the cylindrical outer wall of the insert by an amount lesser than the diameter of the forward band 41.

The female insert housing 16, as best seen in FIG. 4, includes a rear cylindrical portion 44 and an enlarged forward cup-like cylindrical portion 46. An annular groove 47 is formed in the inside surface of the rear cylindrical portion 44 of the female insert housing 16. When the female insert 14 (which is compressible) is pressed into the female insert housing 16, the raised annular rib 42 of the insert is received in the annular inner groove 47 of the insert housing (to resist axial movement); and the larger annular rib 41 of the insert is forced into the enlarged forward portion or collar 46 of the insert housing 16. This structure fixes the insert in the insert housing. The two members 14, 16 are seen in assembled relation in FIG. 7.

Referring then to FIG. 7, the rear or distal end portion of the cylindrical portion 44 of the connector housing 16 may be embedded in the connector overmold 22, though not illustrated. This provides protection for the interface between the conductor wires of cord 24 and the connecting elements 15A of the insert 14, and it further acts to anchor and support the insert 14 and ratchet assembly 18 on the cord, as will be understood from further description.

The tail end of the metal cylindrical portion 44 of the insert housing 16 also provides a means to extend RFI (radio frequency interference) shielding from cable to cable—that is, entirely through the connectors when assembled together. This RFI shielding feature is possible because the conventional braided outer shield of a coaxial or cable or shielded cord may be connected directly to the rear cylindrical portion 44 of the insert housing 16; and the insert housing 16, coupler 19 and outer housing 20 of the female connector may all be made of metal. The corresponding insert housing 28, coupling member 32 and outer housing 34 of the male connector 12 also may be made of metal, so that the rear end of the male insert housing 28 may be similarly connected to a braided shield of the cable 38 if it is an RFI shielded cable. Thus, there is a complete electrical shield between the braided RFI shield of the respective cables 24, 38, if desired.

Figure 9:
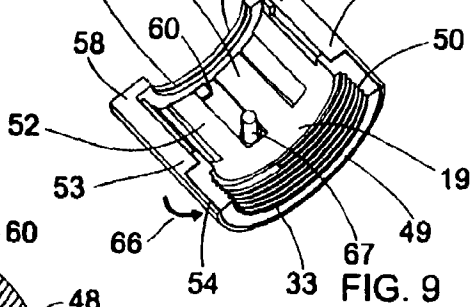
FIG. 9 is a perspective view of the ratchet assembly for the connector of FIG. 5 in cross section and with a decoupling tool inserted.

Turning now to the ratchet assembly 18, and particularly to FIGS. 4 and 9, the coupler 19 includes a forward cylindrical receptacle portion 49 which is internally threaded as at 50, and includes an annular rear wall forming a rear shoulder 51 (FIG. 4). Coupler 19 may be made of metal. Extending rearwardly of the shoulder 51 are a plurality of flexible, resilient fingers or tines 52 which extend rearwardly into the outer housing 20 where they are rotatably received, as best seen in FIG. 9. The outer rear housing 20 includes a cylindrical side wall, the rear portion of which designated 53 is relatively thick, and a forward portion 54 which is thinner. The forward wall 54 defines a receptacle for seating the enlarged internally threaded wall 49 of the coupler female 19 and permits the coupler to rotate.

In seating the female coupler 19 within the outer housing 20, the rear shoulder 51 of the forward cylindrical wall 49 of the coupler engages and seats on a radial ledge or wall 56 of the forward receptacle defined by the thinner wall 54 of the outer housing 20.

Figure 5:
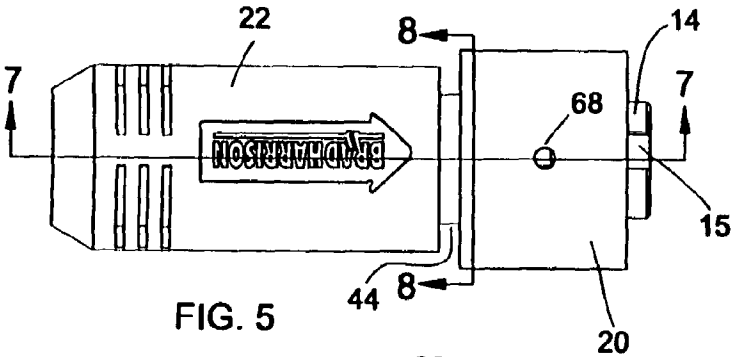
FIG. 5 is a side view of the female connector of FIG. 1.
Figure 6:
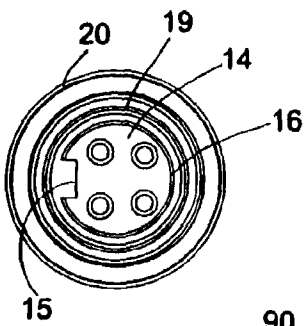
FIG. 6 is a right side view of the connector of FIG. 5.

The outer housing 20 also includes an annular, radial rear wall 58 which defines an opening 59 for passing the conductors of the cable to the insert, and for permitting the rear cylindrical barrel 44 of the insert housing 16 to extend into the connector overmold 22 (FIGS. 5 and 7). The inner edge of the opening 59 forms a circumferential ridge or tongue 90 (FIGS. 7A, 9) which is received in a circumferential groove 91 in the rear cylindrical wall 44 of the insert housing 16. When the metal insert housing is pressed into the outer housing 20, the two are fixed together against relative axial movement by this circular tongue-in-groove connection, but the coupler 32 is permitted to rotate about the axis A (FIG. 3).

The male coupler 32 is limited in forward axial motion by a peripheral lip or flange 61 of the insert housing 16 (FIGS. 4, 7). Thus, the ratchet assembly 30 comprising coupler 32 and outer housing 34 are free to rotate relative to each other (except for the ratchet mechanism to be described presently); however, the coupler 32 and outer housing are restrained against relative axial motion due to the rear, circular tongue-in-groove of FIG. 7A, and the restraining flange 61 of the insert housing 16, which engages an annular shoulder of the coupler, formed by the forward surface of the annular wall 51.

Figure 8:
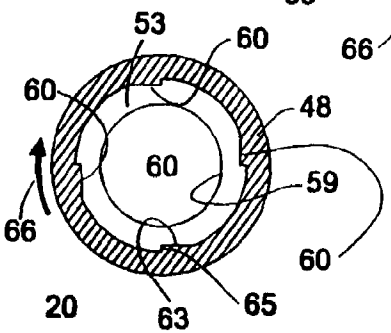
FIG. 8 is a cross sectional view taken through the sight line 8—8 of FIG. 5.

Turning now to FIGS. 8 and 9, formed in the inside surface of the rear, thicker side wall portion 53 of the outer housing 20, integral with the annular wall 58 are a series of four teeth 60. Each of the teeth 60 is similar in configuration, and includes a ramp surface 63 and a radial latching or interference surface 65.

As best seen in FIG. 9, the coupler 19 is slidably received in the outer housing 20. When viewed from the left in FIGS. 1–4, for the female connector, the rotational direction for tightening the female connector into threaded engagement with the male connector is a clockwise rotation (when viewed from the left in FIGS. 1–4). Similarly, the direction of tighter threaded engagement for the male connector requires that the housing 34 be turned in a clockwise direction when viewed from the rear or right side of FIGS. 1–4. Thus, when reference is made to turning a connector housing portion of a ratchet assembly in a clockwise direction or for tightening engagement, it will be assumed that the observer is standing toward the rear and looking in the forward of the associated connector, male or female.

With reference to FIGS. 8 and 9, looking from the rear, the clockwise or direction of tightening engagement of the connector is indicated by the arrow 66—that is, the arrow 66 indicates the direction of turning for the female outer housing 20 to tighten the threads. When the outer housing 20 is rotated in a tightening or clockwise direction, the latch surfaces 65 of the teeth 60 engage the base portion or ends of the fingers or pawls 52 of the female coupler 19. In this mode, the female coupler 19 with the inner threads 33 of wall 49 is secured more tightly or fixed to the female outer housing 20 so that the two turn as one, and the threads 33 are forced into tighter engagement with the exterior threads of the mating male coupler 32.

However, if a user attempts manually to disconnect the two connectors by rotating the outer housing 20 in a counterclockwise direction, the base or free ends of the fingers 52 slide along the ramp surfaces 63 of the teeth 60 and are cammed inwardly toward the axis A to clear the teeth in an overriding action. Because they are of resilient metal, when the fingers or tines 52 pass the ends of the ramp surfaces 63, they flex outwardly to an interfering position with radial surfaces 65. In short, once the two connectors 10, 12 are connected, the outer housing 20 may be rotated freely in the counterclockwise (disconnect) direction, but the coupler 19 and insert/insert housing remain fixed relative to each other due to the coupling force induced in the original connection.

This coupling force may be created by engagement of the two opposing surfaces of the female and male inserts 14, 26. These opposing, surfaces are designated respectively 13 and 25 in FIG. 2. In other words, as the threads of the female and male couplers are progressively engaged, the male and female connecting elements also progressively engage telescopically and axially until eventually the opposing radial surfaces 13, 25 of the inserts 14, 26 engage, and any further tightening creates a frictional force on the threaded engagements of the couplers, thereby increasing the retaining or coupling force.

It is possible to disconnect the two connectors by using a tool having a prong or other insertion element 67 into an aperture 68 in the side wall of the housing 20 (FIG. 1). As seen in FIG. 9, when the insertion element 67 is thus inserted through the aperture 68 and placed in the space between adjacent fingers 52, the female coupler 19 is rotationally connected or coupled to the outer housing 20 so that turning of the outer housing 20 in a counterclockwise or disconnecting rotation also unfastens the coupler 19.

Figure 2:
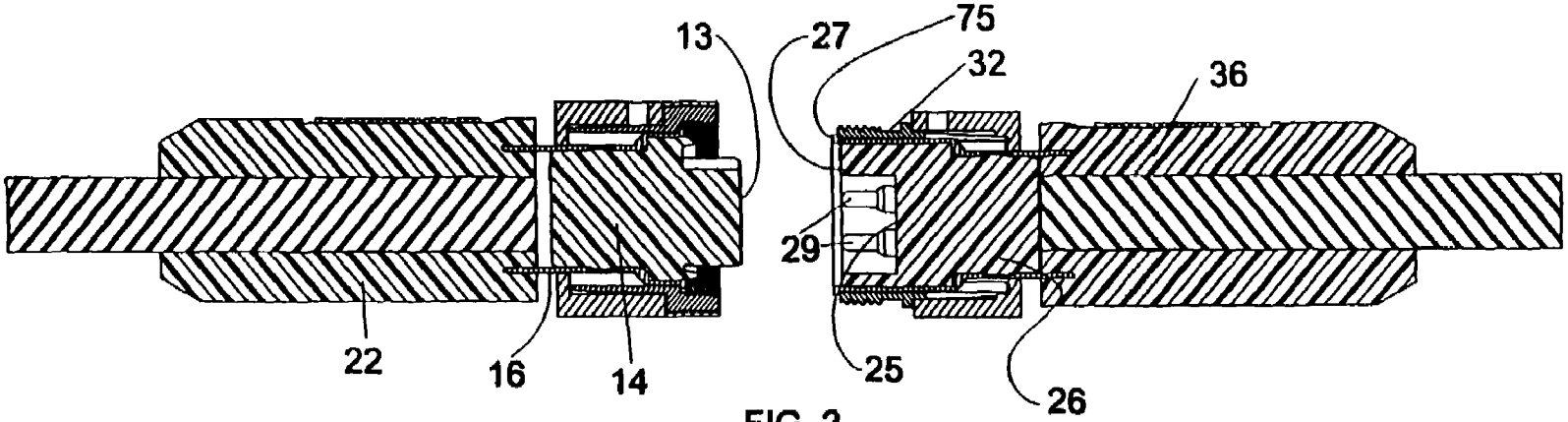
FIG. 2 is a cross sectional view taken along an axial plane indicated by sight line 2—2 of FIG. 1.

Turning now to the male connector 12, and particularly to FIGS. 2–4, the male insert 26 includes a forward cylindrical wall 65 which surrounds the male connecting elements 29. The rear portion 80 of the male insert 26 is of a reduced diameter and defines a circumferential radial positioning surface or collar extending in a generally radial plane and designated 68 in FIG. 4. The rear portion 80 of the insert 26 is of slightly reduced diameter relative to the forward portion 65, and includes a slightly raised circumferential securing rib 69 which is received in an inner circumferential groove 71 of the male insert housing 28 to secure the two against relative axial movement, with the radial positioning surface 68 of the insert engaging and being located by a corresponding inner annular surface 73 of the insert housing 28. The insert housing 28 is in the form of a sleeve, having an enlarged, cup-shaped forward portion 82 and a rear portion 74 of smaller diameter. The forward edge of the insert housing 28 is turned outwardly to form a peripheral flange 75 which limits the forward axial motion of the coupler 32 (see FIG. 2), similar to previously described flange 61 of the female insert housing 16.

The outer forward portion of the male coupler 32 is provided with exterior threads 76; and the rear portion defines the plurality of axially extending, spaced flexible, resilient fingers 77 spaced equally about the axis of the connectors (the axis being identified by line A in FIG. 3). These fingers 77 are flexible and resilient and act as pawls similar to the previously described flexible fingers 52 of the female coupler 19.

The mid section of the male coupler 32 is provided with a outwardly extending peripheral rib 78. When the coupler 32 is assembled over the insert housing 28, the forward edge of the coupler engages and is limited by the forward flange 75 of the insert housing 28. However, the rear edge of the cylindrical wall 74 of the insert housing 28 extends rearwardly beyond the distal ends of the fingers 77 and through an aperture 81 in a rear annular wall 86 of the housing 34 and are embedded in the connector overmold 36, as seen best in FIGS. 1 and 2.

The male outer housing 34 includes a cylindrical side wall 84 and an annular radial rear wall or shoulder 86 which defines the opening 81. An opening 87 is formed in the side wall 84 of the outer housing 34 to receive a tool for placement between adjacent fingers 77 of the male coupler 32 in disconnecting the connectors as previously described in connection with the female connector.

Figure 13:
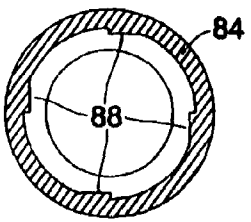
FIG. 13 is a cross sectional view taken through the sight line 13—13 of FIG. 10.
Figure 14:
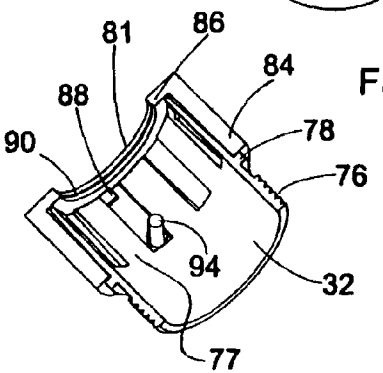
FIG. 14 is a perspective view of the ratchet assembly for the connector of FIG. 10 in cross section and showing a de-coupling tool inserted.

As best seen in FIGS. 13 and 14, a series of four equally spaced teeth 88 are formed on the inner surface of the rear annular wall 86 of the outer housing 34 adjacent the shoulder of rear wall 86.

Figure 12:
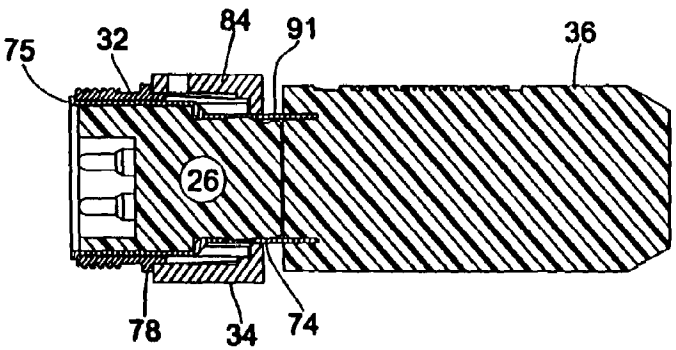
FIG. 12 is a cross sectional view taken through the sight line 12—12 of FIG. 10.
Figure 11:
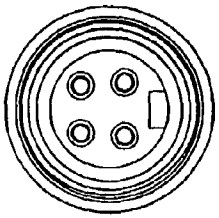
FIG. 11 is a left side view of the male connector of FIG. 10.

The inner surface of the annular wall 86 of the outer housing 34 is provided with a raised rib 90 (FIG. 14) which is fitted into a groove 91 formed on the outer surface of the rear cylindrical portion 74 of the male insert housing 28. This captures the outer housing 34 once the two are assembled, and this, in turn, limits relative axial motion of the outer housing 34 on the insert housing 28. The front edge of the side wall 84 of the outer housing 34 engages the peripheral rib 78 of the coupler 32 (see FIG. 12), thereby limiting the rearward axial motion of the coupler. The forward end of the coupler 32 engages the peripheral flange 75 of the insert housing 28.

Thus, the insert housing of both the male and female connectors perform three functions. First, it limits the forward axial motion of, and thus "captures", both the associated coupler and outer housing. Second, the insert housing seats and secures its associated insert. Third, the insert housing provides the structural interconnection with the connector overmold (22, 36) and provides RFI continuity, when desired. The outer housing in both cases provides the ratchet action permitting the outer housing to ride over the associated coupler in the direction of loosening the connector, while being rigidly engaged to the associated coupler in the direction of tightening threaded engagement of the connector.

As with the female connector, when an elongated pin or rod-like tool point such as is shown at 94 in FIG. 14, is placed in the opening 87 of the side wall 84 of the housing 34, and placed in the space between adjacent fingers 77 of the coupler 32, the coupler 32 and outer housing 34 will become coupled together and rotate in unison in the direction of unscrewing the threads 76 of the coupler 32.

Figure 15:
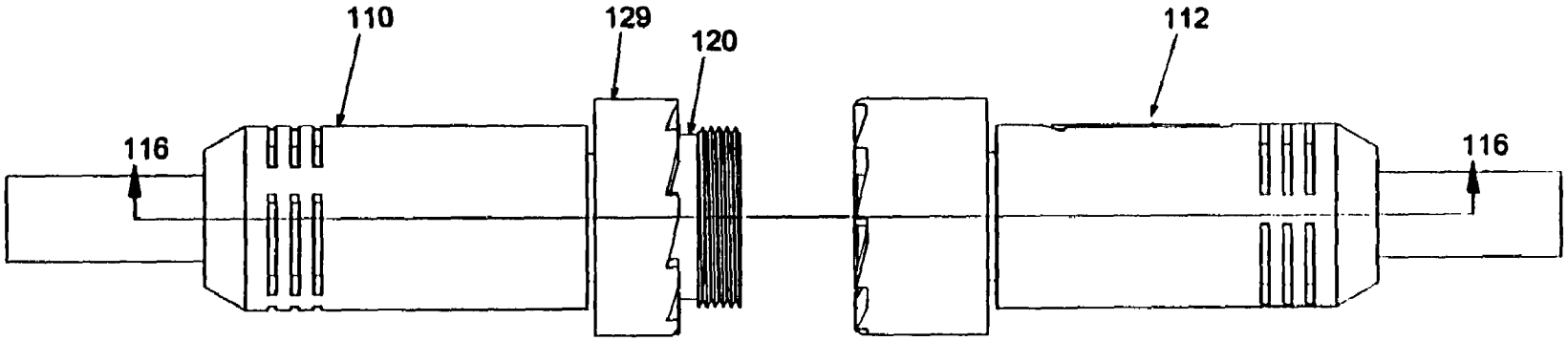
FIG. 15 is a side view of male and female electrical connectors of a second embodiment in a disassembled or disconnected position.

Turning now to the second embodiment of the invention and referring to FIG. 15, reference numeral 110 generally designates a male connector, and reference numeral 112 generally designates a female connector adapted to be coupled to the male connector 110.

Turning first to the male connector 110, reference is made to FIGS. 15–19. The male connector 110 includes a male insert 114 in which there are embedded a number of male connector elements 115 which may be in the form of pins or prongs. The male connector elements are embedded in the insert 114, extending forwardly of a transverse surface 117 of the male insert 114, which may be made of a non-conducting insulating material and which serves to secure and protect the connection between the conductors of wires within a cord (or cable) 116 and the associated connecting elements 115. The junction between the insert 114 and the cord 116 is further protected by a connector overmold 118 which is typically of rubber or other suitable flexible yet abrasion-and force-resistant moldable synthetic material. The insert 114, cord 116 and connector overmold 118 may be of conventional design and materials known to those skilled in this art.

Figure 16:
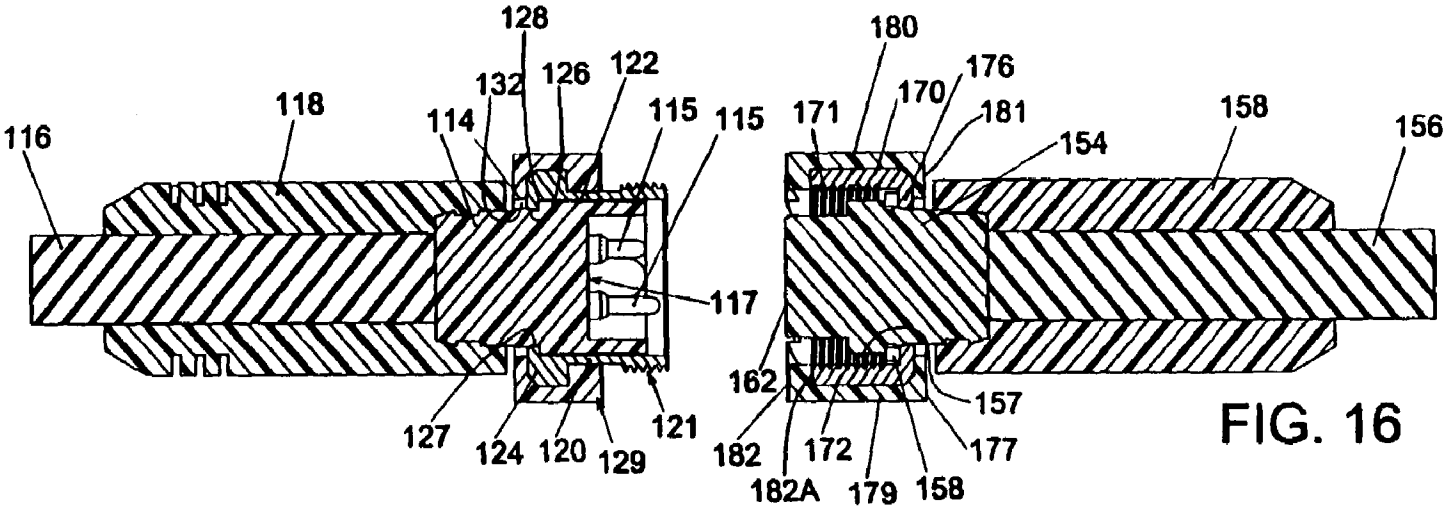
FIG. 16 is a cross sectional view of the connectors of FIG. 15 taken through the sight line 16—16 of FIG. 15.

Turning now particularly to FIG. 16, a male coupler 120 is received on the insert 114. The male coupler 120 may be of metal or plastic, and in the general form of a sleeve or ferrule, includes external threads 121 for connecting to the female connector as will be described. The threads 121 are located toward the "front" of the male connector. In this context, "front" means in the forward axial direction of establishing a connection, and the same convention is used for both male and female connectors, so that "front" referring to the male and female connectors are opposite directions in FIG. 15. That is, the front of both male and female connectors coaxially engage one another.

The center portion of the male coupler 120 is generally cylindrical as at 122, and the rear portion of the male coupler includes an enlarged annular outer flange 124, the rear portion of which includes an inner, annular shoulder 126. The annular shoulder 126 of the coupler 120 may be received in a recess of the insert 114 and engage a shoulder 128 so that the male coupler 120 and male insert 114 are fixed together in the axial direction when the male coupler is threaded into the female coupler of the mating connector. However, the male coupler 120 is received on the insert 114 in a sliding fit so that the coupler may be rotated manually.

An annular overmold 129 is formed on the coupler 120, encompassing the rear flange of the coupler 120. The male coupler overmold 129 defines a rear opening 132 which provides a non-obstructing clearance with the male insert 114.

Figure 18:
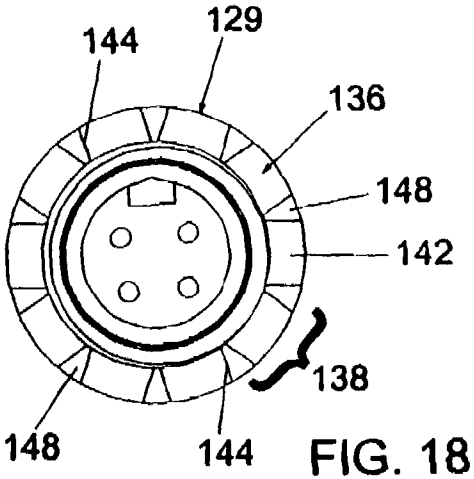
FIG. 18 is a right side view of the male connector of FIG. 17.
Figure 17:
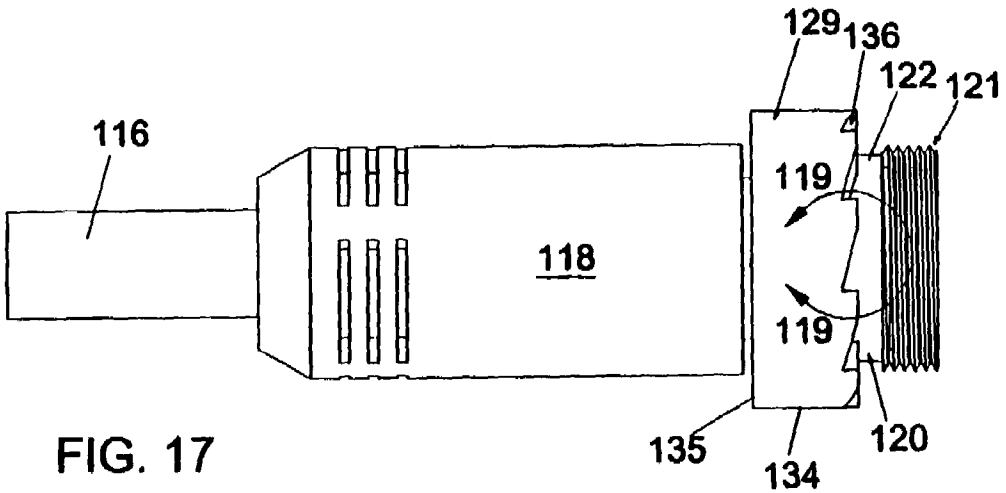
FIG. 17 is a side view of the male connector of FIG. 15.
Figure 19:
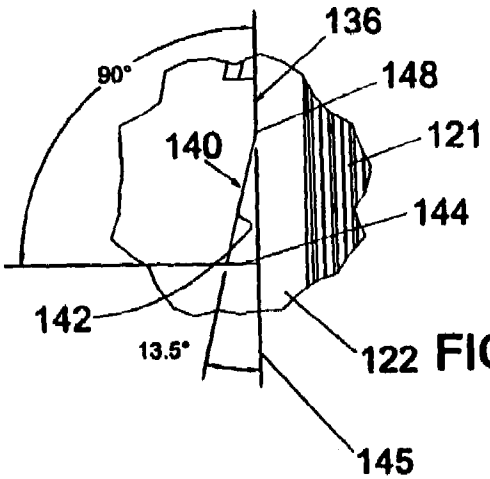
FIG. 19 is an enlarged view of the circled portion 19—19 of FIG. 17.
Figure 21:
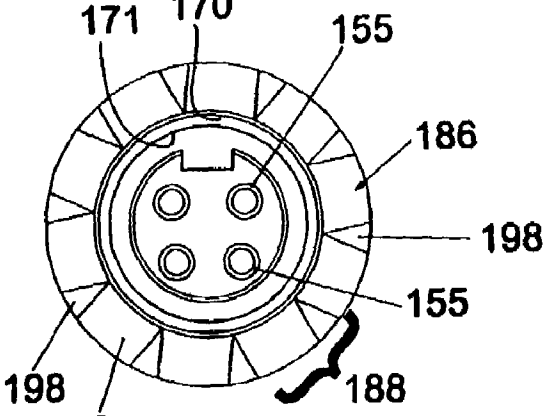
FIG. 21 is an end view of the female connector of FIG. 20.

Turning now to the male coupler overmold 129, with particular reference to FIGS. 17–19, the coupler overmold 129 may be made of a plastic material, such as polyvinylchloride. It may have a durometer reading of approximately 90 on the Shore A scale and within the range of 10 to 100 on the Shore A scale depending on the application. It is thus a semi-rigid, but yieldable, resilient material, as will be understood by those skilled in the art. The male coupler overmold 129 has an outer cylindrical wall having a surface 134, a rear annular wall having a surface 135 which is adjacent, but spaced forwardly of the connector overmold 118, and a forward surface. The forward surface of the coupler overmold 129 forms a first ratchet interface surface 136, the details of which are seen in FIG. 19 for a portion of the overmold enclosed within the circle 19—19 of FIG. 17. The ratchet interface surface 136 includes a series of ratchet sections such as the one bracketed at 138 in FIG. 18 and seen in close-up FIG. 19. The ratchet sections 138 may be spaced equally about the front surface 136 of the male coupler overmold 129. Moreover, the entire front surface of the overmold 129 need not contain ratchet sections.

It will be observed that the forward ratchet surface 136 has an annular shape, and the ratchet interface occupies most if not all of the area of the annular forward surface of the coupler overmold 129. Thus, a description of one such section 138 of the ratchet interface surface is sufficient to understand the entirety of the ratchet interface surface.

Turning then to FIG. 19, each ratchet section 138 includes a wedge-shaped recess 140 comprising a tooth including ramp surface portion 142 and a radial latch or contact surface 144. The ramp surface 142 is substantially planar and the outer edge may form an angle of approximately 13.5 degrees with a radial plane extending perpendicular of the axis of the connector and identified by reference numeral 145 in FIG. 19. It will be understood, however, that the ramp surface 142 may be inclined slightly such that the outer edge is located slightly in the forward direction relative to the inner edge. In short, the ramp surface need not extend in a radial plane (i.e. perpendicular to the plane of the page). The ramp surface 142 extends forwardly from its base about the coupler overmold 129 to form a land portion 148 which lies in the plane of the radial plane 145 of the coupler overmold 129.

Turning now to the female connector 112, and particularly to FIGS. 16 and 20–22, the female connector 112 includes a female insert 154, in which are embedded a plurality of female connecting elements 155 (FIG. 21) which may be in the form of tubular sleeves for establishing electrical contact with the male connecting elements 115. The female connector elements 155 are embedded and secured by the female insert 154; and they are connected to conductors of an electrical cord 156. A connector overmold 158 straddles and protects the junction between the female insert 154 and the electrical cord 156.

Figure 20:
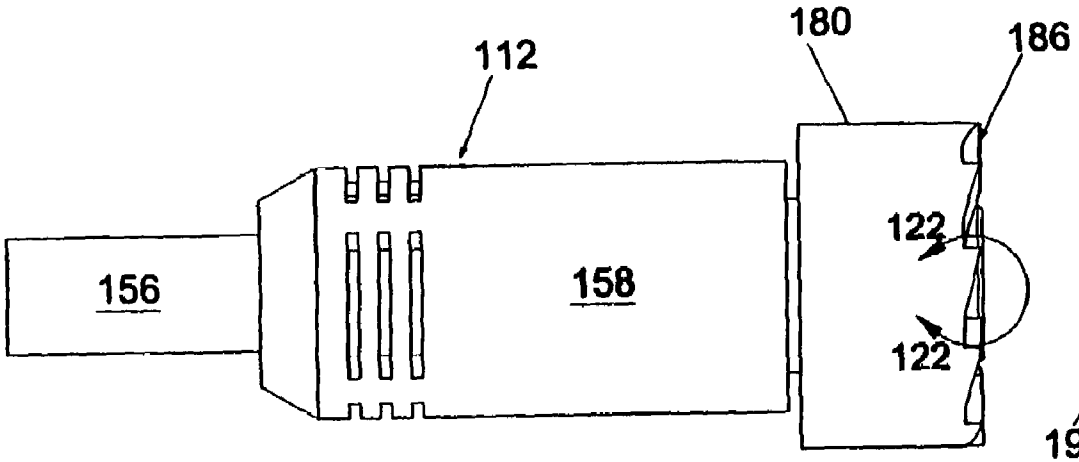
FIG. 20 is a side view of the female connector of FIG. 15.
Figure 22:
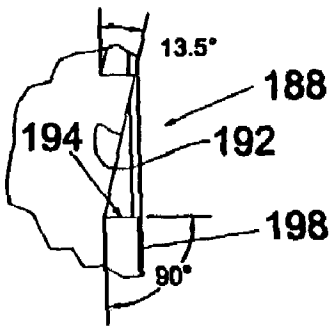
FIG. 22 is a close-up view of the circled portion 22—22 of FIG. 20.

Turning now particularly to FIGS. 16 and 20, a female coupler 170, also in the general form of a sleeve or ferrule, having inner threads 171 for engaging with the mating threads 121 of the male coupler 120, is received on the female insert 154 as best seen in FIG. 16. Specifically, the rear of the female coupler 170 includes an annular shoulder 176 which is received on the insert 154 in sliding engagement, and may not be removed from the female insert 154 because an annular rib 157 is located forward of the rear shoulder 176 of the female coupler 170, which preferably is metal. A conventional slip ring 158 is located between the rear of the annular rib 157 of the insert 154 and the rear shoulder 176 of the female coupler 170.

The forward portion of the female coupler 170 forms a generally cylindrical wall 182A which terminates in a radial plane slightly rearward of the forwardmost surface 162 of the insert 154, as best seen in FIG. 16.

An overmold 179 is formed on the exterior of the female coupler 170. The material of the coupler overmold 179 may be similar to the material of the coupler overmold 129 discussed above. The coupler overmold 179 includes a cylindrical side wall 180, a rear annular wall 181 and a forward partial or annular wall 182 which cooperate to capture the coupler 170.

Turning now particularly to FIG. 20, the forward surface of the female coupler overmold 179 designated 186 forms a ratchet interface surface which conforms to and couples with the corresponding ratchet interface surface 136 of the overmold 129 of the male coupler 120. Specifically, referring to FIG. 22, the ratchet interface surface 186 includes a plurality of ramp sections 188, (bracketed in FIG. 21), one of which is seen enlarged in FIG. 22. Each ramp section 188 includes a surface or wall 192 which is inclined relative to a radial plane, and a latching or engaging surface 194 which extends in a general axial direction of the connector, and a portion 198 which forms a land—that is, a planar surface forming a triangular section lying in a generally radial plane to form a series of teeth sized and located to engage the teeth of the overmold of the mating coupler.

Referring to FIG. 16, when the male and female connector inserts are coaxially aligned and urged toward one another in a "forward" direction, the inner threads 171 of the female coupler 170 will engage the outer threads 121 of the male coupler 120. The outer cylindrical surfaces of the coupler overmolds 129, 179 may then be grasped in the left and right hands respectively of the user, and turned, thereby engaging the threads and establishing the electrical connection. As the threads are continued to be turned and engaged, eventually the ratchet interface surface 186 of the overmold 179 of the female connector 112 and the ratchet interface surface 136 of the male connector overmold 129 will begin to engage. Because of the slight yielding of the coupler overmolds, the two ratchet interface surfaces 136, 186 will override one another in the fastening or connecting direction. In the illustrated embodiment, when viewed from the rear of a connecting interface, the coupler element is turned clockwise to fasten.

After a suitable angular turning, the respective axial latch surfaces 144 of the male coupler overmold and 194 of the female coupler overmold will have sufficient surface area contact and the corresponding latch surfaces 144, 195 will engage and lock, such that a substantial locking force is present and the two connectors can be disassembled manually only with substantial force, and eventually, as the couplers are tightened further, it will require tools to disassemble the connector elements. However, because of the nature of the yielding, resilient plastic materials used for the coupler overmolds, the coupler overmolds are not destroyed nor is their ratcheting action and latching ability substantially diminished.

As the coupler overmolds engage, a retaining or coupling force will be created on the engaging threads 121, 171 which will increase as the couplers are rotated in the connecting direction, creating a progressively increasing coupling force adding to the coupling force of the ratchet interface. The two opposing insert surfaces 117, 162 may also engage in establishing the coupling force.

As with conventional quick-disconnect connectors, the connectors may be keyed or the configuration of the connecting elements arranged so that the desired connections are made. Further, indicia such as large arrows or the like may be molded into the connector overmolds 118, 158 to assist in aligning the connectors properly for the keyed coupling and proper connections of the connectors.

Having thus disclosed in detail the illustrated embodiments of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within the spirit and scope of the appended claims.

We claim:

1. An electrical connecting device comprising:

a male connector including;

a male insert;

at least one male connecting element carried by said male insert;

a male coupler having exterior threads adjacent a forward end; and a first coupler overmold engaging an outer surface of said male coupler and having a forward portion defining a first ratchet interface surface extending circumferentially about said forward portion of said male coupler; and a female connector including;

a female insert;

at least one female connecting element carried by said female insert and constructed and arranged to couple electrically with said male connecting element when said male and female connectors are assembled together;

a female coupler rotatably mounted on said female insert and limited in movement along an axis thereof; and a second coupler overmold engaging an outer surface of said female coupler and having a forward portion defining a second ratchet surface extending circumferentially about said forward portion of said second coupler and adapted to engage with locking force to said first ratchet surface of said first connector when said first and second couplers are fastened together;

said first and second overmolds being made of deformable, resilient material of a hardness rendering it difficult to disconnect said connectors manually.

2. The device of claim 1 wherein said material of said first and second overmolds is a synthetic material having a durometer rating in the range of approximately 10 to 100 on the Shore A scale.

3. The device of claim 2 wherein said durometer rating is approximately 90 on the Shore A scale.

4. The device of claim 1 wherein said each of said ratchet surfaces comprises a plurality of sections extending circumferentially about an axis of an associated connector, each section including a tooth-shaped portion including an axial surface, a generally flat surface, and an inclined surface extending from an axial surface of an adjacent section to an associated flat surface.

5. The device of claim 1 wherein said male coupler has exterior threads and said female coupler has interior threads.

6. The device of claim 5 wherein said male coupler includes a peripheral flange and said overmold thereof encloses said peripheral flange.

7. The device of claim 5 wherein said overmold of said female connector engages and covers substantially all exterior surfaces of said female coupler.

* * * * *